United States Patent [19]

Gross et al.

[11] Patent Number: 4,710,285

[45] Date of Patent: Dec. 1, 1987

[54] VERMICULITE FLOTATION PROMOTER

[75] Inventors: Anthony E. Gross, St. Charles; Richard D. Christie, Downers Grove, both of Ill.; Thomas E. Pinder, Fort Mill, S.C.

[73] Assignee: Nalco Chemical Company, Naperville, Ill.

[21] Appl. No.: 937,843

[22] Filed: Dec. 4, 1986

[51] Int. Cl.[4] ..... B03D 1/02

[52] U.S. Cl. ..... 209/166; 252/61

[58] Field of Search ..... 209/166, 167; 106/DIG. 2; 252/61, 378 R, 378 P

[56] References Cited

U.S. PATENT DOCUMENTS 4,466,887 8/1984 Gross ..... 209/166

OTHER PUBLICATIONS

Bureau of Mines Report of Investigation, #4486, 7/1949, by W. McMillan and A. W. Gerhardt, pp. 36–41.

*Primary Examiner*—S. Leon Bashore
*Assistant Examiner*—Thomas M. Lithgow
*Attorney, Agent, or Firm*—John G. Premo; Donald G. Epple; Anthony L. Cupoli

[57] ABSTRACT

An improved method for the froth flotation recovery and/or grade of vermiculite from vermiculite containing rock and clay. It uses a composition comprising oil and between 2–60% by weight of an alkyl phenol formaldehyde condensation product.

2 Claims, No Drawings

VERMICULITE FLOTATION PROMOTER

INTRODUCTION

Vermiculite flotation is accomplished by two different mechanical processes. In one process, reagents are added to a pulp of ore in water and air is induced by a subaeration cell. The mineralized froth is collected at the top of the cell. In the second process, reagents are added to a thick pulp with agitation that will entrain air. Separation is made in a gravity separation device such as a shaking table.

A typical flotation reagent composition now in use for floating vermiculite from vermiculite-containing rock, clay and quartz comprises a so-called black oil which is a No. 4 or 6 fuel oil or No. 2 fuel oil and a high-molecular weight monoamine exemplified by the well-known rosin amines as collectors. Optionally, small amounts of alum and a frother such as pine oil or methyl isobutylcarbinol are also included.

It is a purpose of this invention to provide an improved collector for vermiculite flotation which increases recovery of vermiculite during the flotation process and also produces an improved grade of vermiculite.

THE INVENTION

The invention, in its broadest aspects, furnishes a method for improving the froth flotation recovery and/or grade of vermiculite from vermiculite-containing rock and clay which comprises using as an improved froth flotation collector a composition comprised of an alkyl phenol formaldehyde condensation product having 4–15 phenol nuclei with the alkyl group of said phenol having between 4–15 carbon atoms, such new composition to be utilized in conjunction with the typical oil and monoamine reagents.

THE PHENOL-FORMALDEHYDE CONDENSATION PRODUCTS

The phenol formaldehyde condensation products are prepared by reacting formaldehyde or a substance which breaks down to formaldehyde under the reaction conditions, e.g., paraformaldehyde and trioxane, and a difunctional, monoalkyl phenol, such as a substantially pure ortho- or para-monoalkyl phenol or a crude alkyl phenol consisting of at least 75% difunctional phenol, by heating the reactants in the presence of a small amount of acid catalysts such as sulfamic acid. The aqueous distillate which begins to form is collected and removed from the reaction mixture. After several hours of heating at temperatures slightly above the boiling point of water, the mass becomes viscous and is permitted to cool to about 100° to 105° C. At this point a suitable hydrodcarbon fraction is added, and heating is resumed. Further aqueous distillate begins to form and heating is continued for an additional number of hours until at least about one mol of aqueous distillate per mol of reactants has been secured. The product is permitted to cool to yield the phenol-formaldehyde condensation product in a hydrocarbon solvent. The solubility of the condensation product in hydrocarbon solvents such as $SO_2$ extract would indicate that the resin is a linear type polymer, thus distinguishing them from the more common phenol-formaldehyde resins of the cross-linked type.

A method of preparing resins of the type described above is set forth in U.S. Pat. No. 3,244,770, the disclosure of which is incorporated herein by reference.

The amount of resin that may be combined with the oil may vary from 2–60%. Good results are often obtained when the amount is within 5–25% by weight. The dosage of the flotation agent will be that amount normally used by the industry to achieve good flotation. The compositions of the invention may contain 1–10% of an amine such as a rosin amine as an optional ingredient.

TYPICAL COMPOSITION

A typical composition of the invention comprises a nonylphenol which has been reacted with formaldehyde under acidic conditions as previously described to produce a molecular weight of about 2,000 which means that the average number of nonyl phenol units in the polymer is about 9. This typical composition contains about 70% by weight of the condensate resin with the balance being an aromatic hydrocarbon solvent of the type derived from the distillation or cracking of petroleum. This therefore describes the composition which is hereafter in the tests referred to as Composition No. 1. Another Composition, hereafter Composition 2, was prepared containing 50% by weight of the above described resin with the balance being an aromatic hydrocarbon solvent.

Composition No. 1 was tested on a laboratory scale with the subaeration process at a vermiculite manufacturing company to determine its efficacy. The results of these tests are set forth below:

EXAMPLE 1

| Test #1 | % Composition No. 1 in Black Oil | Alum | CC's Dosage Black Oil | Resin | Amine[1] |
|---|---|---|---|---|---|
| 1 | Blank Case | 1.9 | 2.0 | 0 | 3 |
| 2 | 10% Resin | 1.9 | 1.8 | 0.2 | 3 |
| 3 | 20% Resin | 1.9 | 1.6 | 0.4 | 3 |
| 4 | 30% Resin | 1.9 | 1.4 | 0.6 | 3 |

[1]Rosin amine.

The results are set forth in Table I.

TABLE I

| Resin in #4 Black Oil (%) | Vermiculite (%) Recovery | Grade |
|---|---|---|
| 0 | 74.5 | 61.95 |
| 10 | 65.4 | 66.2 |
| 20 | 65.3 | 67.0 |
| 30 | 74.4 | 70.6 |

EXAMPLE 2

Composition No. 2 was then tested in the plant using the table flotation process. The results are set forth below in Table II.

TABLE II

| Composition No. 2 (cc/min) | #4 Black Oil (cc/min) | Vermiculite (%) Recovery | Grade |
|---|---|---|---|
| 0 | 1900 | 72.86 | 92.52 |
| 600 | 1900 | 83.86 | 91.22 |
| 1200 | 1900 | 81.18 | 93.26 |

Based on the above, it is seen that an advance in the art in vermiculite flotation has been provided.

Having thus described our invention, we claim:

1. A method for improving the froth flotation recovery and/or grade of vermiculite from vermiculite containing rock and clay which comprises using as an improved froth flotation collector a composition comprising oil and between 2–60% by weight of an alkyl phenol formaldehyde condensation product having 4–15 phenol nuclei with the alkyl group of said phenol having between 4–15 carbon atoms.

2. The method of claim 1 where the alkyl group contains 9 carbon atoms and the condensation produced has a molecular weight of about 2,000.

* * * * *